US009045921B2

(12) United States Patent
Eggeling et al.

(10) Patent No.: US 9,045,921 B2
(45) Date of Patent: Jun. 2, 2015

(54) METHOD FOR OPERATING A HATCH ARRANGEMENT OF A MOTOR VEHICLE

(75) Inventors: Juergen Eggeling, Muelheim an de Ruhr (DE); Dirk Hellmich, Duisburg (DE); Klaus Duenne, Ratingen (DE)

(73) Assignee: BROSE FAHRZEUGTEILE GMBH & CO. KG, HALLSTADT, Hallstadt (DE)

( * ) Notice: Subject to any disclaimer, the term of this patent is extended or adjusted under 35 U.S.C. 154(b) by 250 days.

(21) Appl. No.: 13/468,700

(22) Filed: May 10, 2012

(65) Prior Publication Data

US 2012/0285087 A1 Nov. 15, 2012

(30) Foreign Application Priority Data

May 11, 2011 (DE) ..... 10 2011 101 266

(51) Int. Cl.

| | |
|---|---|
| ***E05C 3/06*** | (2006.01) |
| ***E05B 81/14*** | (2014.01) |
| ***E05B 83/18*** | (2014.01) |
| *E05B 79/20* | (2014.01) |

(52) U.S. Cl.

CPC ..... *E05B 81/14* (2013.01); *E05B 79/20* (2013.01); *E05B 83/18* (2013.01)

(58) Field of Classification Search

CPC ..... E05B 81/14; E05B 81/20; E05B 81/06; E05B 81/00; E05B 83/18; E05B 81/25

USPC ..... 296/146.8, 106, 216.02, 76, 146.4; 292/201, 216, 256.5

See application file for complete search history.

(56) References Cited

U.S. PATENT DOCUMENTS

| | | | | |
|---|---|---|---|---|
| 8,534,743 | B2 * | 9/2013 | Scheler | 296/146.8 |
| 2009/0165386 | A1 * | 7/2009 | Suzuki et al. | 49/282 |
| 2011/0016794 | A1 * | 1/2011 | Nishikibe et al. | 49/359 |

FOREIGN PATENT DOCUMENTS

| | | | |
|---|---|---|---|
| DE | 10247019 | A1 | 5/2003 |
| DE | 202005020085 | U1 | 6/2007 |
| DE | 102006061523 | A1 | 6/2008 |
| DE | 102009010302 | A1 | 10/2009 |

* cited by examiner

*Primary Examiner* — Mark Williams

(74) *Attorney, Agent, or Firm* — Pauly, DeVries, Smith & Deffner, LLC

(57) ABSTRACT

Described herein is a method for operating a hatch arrangement of a motor vehicle wherein a motor vehicle lock is controlled by means of a control arrangement in a relatch routine in such a way that a renewed latch state (a relatch state) is avoided or cancelled within a predetermined relatch time interval after the releasing process, and wherein in a relatch monitoring process the control arrangement monitors whether a relatch indication, in particular a relatch state, occurs within the predetermined relatch time interval after the releasing process and only then is the relatch routine triggered.

19 Claims, 2 Drawing Sheets

METHOD FOR OPERATING A HATCH ARRANGEMENT OF A MOTOR VEHICLE

CROSS-REFERENCE TO RELATED APPLICATIONS

This application claims the benefit of German Patent Application No. DE 10 2011 101 266.8, filed May 11, 2011, the disclosure of which is incorporated by reference herein in its entirety.

FIELD OF THE INVENTION

The present invention relates to a method for operating a hatch arrangement of a motor vehicle and to a control arrangement for a hatch arrangement of a motor vehicle. The method in question relates to the opening process for a hatch door of a motor vehicle. The term "hatch door" is to be understood comprehensively here. It includes tailgates, rear lids, engine bonnets, doors, in particular side doors, luggage space floors or the like of a motor vehicle.

BACKGROUND OF THE INVENTION

The hatch arrangement (DE 20 2005 020 085 U1) in question is equipped with a hatch door, a motor vehicle lock and a control arrangement, wherein the motor vehicle lock is equipped with the customary lock components of a lock latch and a detent pawl. In a latched state, the lock latch is in securing engagement with a locking wedge, while in a released state the locking wedge is released by the lock latch. The detent pawl has the function here of securing the lock latch in the respective latching position.

In the course of the increasing of comfort in motor vehicles, the motor vehicle lock in question has been equipped with an opening drive by which the detent pawl is lifted out in a motor-powered releasing process, triggered by the control arrangement. The motor vehicle lock is correspondingly adjusted from a latched state into a released state.

In the known hatch arrangement, the releasing process occurs in a fully automated fashion, with the result that there is no need for any assisting intervention by the driver whatsoever. The known hatch arrangement is also equipped with a motor-powered hatch drive which implements an opening process which follows the releasing process.

When the hatch door is in the locked position, high sealing counter pressures generally act in the known hatch arrangement, which counter pressures can cause the hatch door to jump out during motor-powered lifting out of the detent pawl and the associated releasing of the locking wedge. In the most unfavourable case, the jumping out of the hatch door is followed by the hatch door dropping back due to gravity into a possibly present prelatching position of the motor vehicle lock. This dropping back of the motor vehicle lock into a renewed latch state is referred to as a "relatch process". The occurrence of the renewed latch state, here the "relatch state" is considered to be a loss of comfort by the user.

Some motor vehicle locks are equipped with what is referred to as a snow load function. That is to say the detent pawl of the motor vehicle lock is held in its lifted-out position after the releasing process until the hatch door has reached a minimum deflection. The minimum deflection is usually the hatch deflection in which the locking wedge or the like leaves the lock latch. If the above jumping up of the hatch door remains below the minimum deflection, a relatch process cannot occur here since the detent pawl is prevented from dropping in. However, the jumping up of the hatch door generally goes beyond the minimum deflection, as a result of which the snow load function is not helpful in avoiding the relatch process. Basically, although it would be possible to extend the minimum deflection here, it would involve quite considerable structural expenditure.

SUMMARY OF THE INVENTION

The invention is based on the problem of optimizing the known method for operating a hatch arrangement with respect to the occurrence of a relatch state involving little expenditure.

The above problem is solved in a method for operating a hatch arrangement of a motor vehicle, wherein the hatch arrangement has a hatch door, a motor vehicle lock and a control arrangement, wherein in a latched state the motor vehicle lock is in securing engagement with a locking wedge or the like, and in a released state the motor vehicle lock releases the locking wedge or the like, wherein the motor vehicle lock is moved into engagement with the locking wedge or the like by adjusting the hatch door in the closing direction, and in the process, if appropriate, said motor vehicle lock is moved into a latched state, and wherein the motor vehicle lock is moved, when triggered by the control arrangement, from a latched state into a released state in a motor-powered releasing process by means of an opening drive, by means of a motor vehicle lock controlled by means of the control arrangement in a relatch routine in such a way that a renewed latch state (also referred to herein as a relatch state) is avoided or cancelled within a predetermined relatch time interval after the releasing process, and in that in a relatch monitoring process the control arrangement monitors whether a relatch indication, in particular a relatch state, occurs within the predetermined relatch time interval after the releasing process and only then is the relatch routine triggered.

What is significant is the idea that the above relatch state can easily be avoided or cancelled with control means. Structural measures are correspondingly not necessary for this.

In particular it is proposed that the motor vehicle lock be controlled by means of the control arrangement in a relatch routine in such a way that a renewed latch state—relatch state—is avoided or cancelled within a predetermined relatched time interval after the releasing process.

The term "relatch routine" means here quite generally that after the start of the "relatch routine" the control arrangement operates according to a predetermined control strategy which avoids or cancels a relatch state as explained above. The relatch routine can be implemented by software or else by hardware.

In one particularly preferred refinement there is provision to monitor the relatch time interval to determine whether a relatch state occurs in this time interval. If a relatch state is detected in this way, the control arrangement triggers the "relatch routine". Finally it is checked here whether the motor vehicle lock drops back into a latched state after the releasing process. This can be readily implemented with the interrogation elements, present in any case in the contemporary motor vehicle locks, for determining the state of the lock. Preferably the relatch routine is triggered if, and only if, the relatch state is also detected.

The fact that the above monitoring can also be carried out to determine whether only a relatch indication occurs is interesting. Such a relatch indication may be, for example, a resetting movement of the hatch door subsequent to the releasing process, which movement is an indication that a relatch state will occur. It is possible to define other relatch indications.

In one embodiment, a hatch drive which is assigned to the hatch door is provided, wherein the control arrangement triggers a motor-powered opening process in the opening direction and/or a motor-powered closing process in the closing direction, in particular, by means of predetermined user actions, in that a motor-powered releasing process always precedes a motor-powered opening process, and in that the relatch routine is configured in such a way that when a relatch state is detected a securing engagement of the motor vehicle lock with the lock wedge or the like is avoided or released during the opening process.

In the more preferred refinement, the relatch routine consists in triggering a further motor-powered releasing process. As a result, a particularly high level of protection can be achieved against an undesired renewed latch state leading to the loss of comfort described above. In particular, a further motor-powered releasing process is triggered in the relatch routine.

In one embodiment, the relatch routine the motor vehicle lock is placed in the released state by means of the control arrangement for a predetermined release time interval or until a predetermined hatch deflection is reached, preferably in that the release time interval is at least 2 s, preferably at least 3 s.

In another embodiment, the width of the relatch time interval is less than 5 s, preferably less than 3 s, and/or the relatch monitoring for detecting a relatch state extends from a releasing process via a monitoring time interval whose width is less than three times, preferably less than twice, the width of the relatch time interval.

In another embodiment, during the relatch monitoring the sampling rate of the control arrangement is at least 10 Hz, preferably at least 100 Hz, more preferably at least 200 Hz, for the detection of the state of the lock.

In another embodiment, the motor vehicle lock has a lock latch and a detent pawl assigned to the lock latch, and in the released state the lock latch is in an open position and in the latched state it is in a prelatching position or in a main latching position, wherein the detent pawl can be moved into a dropped-in position in which it holds the lock latch in the prelatching position or in the main latching position, and it can be moved by means of the opening drive into a lifted-out position in which it releases the lock latch, preferably in that a sensor arrangement is provided for sensing the state of the lock, more preferably in that the sensor arrangement serves to sense the position of the lock latch and/or of the detent pawl, more preferably in that in the relatch monitoring process the control arrangement monitors the position of the lock latch and/or of the detent pawl, preferably in that movement of the lock latch from the open position in the closing direction is defined as a relatch indication.

In one embodiment, the invention provides a control arrangement for a hatch arrangement of a motor vehicle, wherein the hatch arrangement has a hatch door, a motor vehicle lock and a control arrangement, wherein in a latched state the motor vehicle lock is in securing engagement with a locking wedge or the like, and in a released state the motor vehicle lock releases the locking wedge or the like, wherein the motor vehicle lock can be moved into engagement with the locking wedge or the like by adjusting the hatch door in the closing direction, and in the process, if appropriate, said motor vehicle lock can be moved into a latched state, and wherein the motor vehicle lock can be moved, when triggered by the control arrangement, from a latched state into a released state in a motor-powered releasing process by means of an opening drive, wherein the control arrangement controls the motor vehicle lock in a relatch routine in such a way that a renewed latch state—relatch state—is avoided or cancelled within a predetermined relatch time interval after the releasing process, and in that in a relatch monitoring process the control arrangement monitors whether a relatch indication, in particular a relatch state, occurs within the predetermined relatch time interval after the releasing process, and only then triggers the relatch routine.

According to a further teaching, which is also accorded independent significance, the control arrangement with which the above method according to the proposal is implemented is claimed as such. In this regard, reference may be made to all the statements relating to the method according to the proposal.

BRIEF DESCRIPTION OF THE FIGURES

The invention will be explained in more detail below on the basis of a drawing which merely illustrates an exemplary embodiment. In the drawing.

DETAILED DESCRIPTION

Figure 1:
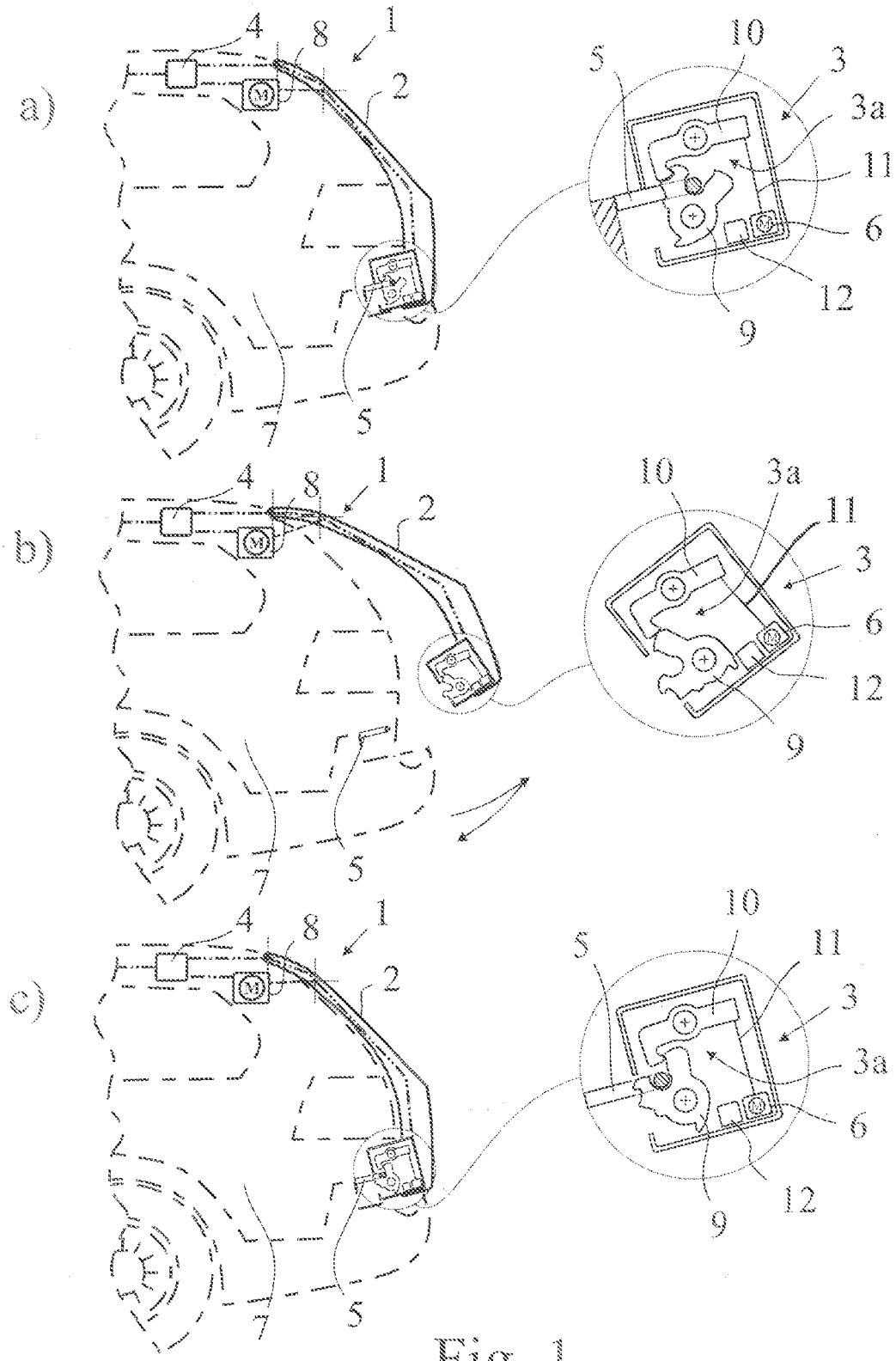
FIG. 1 shows a hatch arrangement according to the proposal a) with a hatch door in the locked position, and a lock latch in the main latched position (b) after the releasing process during the jumping up of the hatch door and c) when the motor vehicle lock is in the relatch state.

The hatch arrangement 1 illustrated in the drawing is equipped in a customary fashion with a hatch door 2, a motor vehicle lock 3 and a control arrangement 4. All these components are illustrated in a highly schematic form in the drawing.

The control arrangement 4 can be coupled, on the one hand, to a superordinate controller and, on the other hand, to the components to be actuated via a bus system, in particular via a CAN bus system. The control arrangement 4 can, as shown in FIG. 1, have a self-contained structure or else be distributed in a decentralized fashion.

The hatch door 2 here is preferably the tailgate of a motor vehicle. However, the term "hatch door" is, as indicated above, to be interpreted widely and includes, inter alia, rear lids, engine bonnets, doors, in particular side doors, luggage space floors or the like of a motor vehicle.

The motor vehicle lock 3 is equipped with the likewise customary lock elements 3*a*, which will be explained below. In a latched state (FIGS. 1*a, c*), said motor vehicle lock 3 is in securing engagement with a locking wedge 5 or the like and in a released state it releases the locking wedge 5 or the like. If appropriate, a main latched state and a prelatched state, located before the main latched state, are provided, as is also explained with reference to FIG. 1. When the hatch door 2 is adjusted in the closing direction, the motor vehicle lock 3 enters into engagement with the locking wedge 5 or the like and is thereby adjusted, if appropriate, into one of the latched states, as is shown by the transition from FIG. 1*b* to FIG. 1*c*.

The motor vehicle lock can be moved, when triggered by the control arrangement 4, from a latched state (FIGS. 1*a, c*) into a released state (FIG. 1*b*) in a motor-powered releasing process by means of an opening drive 6. What is significant at this point is that the motor vehicle lock 3 releases the locking wedge 5 or the like during the releasing process, with the result that the hatch door 2 can pivot in the opening direction free of the coupling between the motor vehicle lock 3 and the locking wedge 5.

The succession of figures, FIGS. 1*a, b, c*, shows the relatch process which is in the foreground and leads into a renewed latch state of the motor vehicle lock, the relatch state here. The transition from FIG. 1*a* to FIG. 1*b* shows the releasing process in which the hatch door 2 jumps in the opening direction, driven by the sealing counter pressure between the hatch door 2 and the motor vehicle body 7. This jumping up of the hatch door 2 takes place counter to the force of the weight of the hatch door 2 and, if appropriate, counter to the spring force of a hatch spring or the like. The hatch door 2 subsequently drops, driven by its weight force, in the closing direction. This is shown by the transition from FIG. 1*b* to FIG. 1*c*. From the illustration in FIG. 1*c* it is apparent that the motor vehicle lock 3 has dropped back into a latched state, specifically into the prelatched state. For the user this means that the hatch door 2 is again blocked from being opened by the motor vehicle lock 3 which is in the prelatched state.

In order nevertheless to permit the user to open the hatch door 2 without an additional user input, it is provided according to the proposal that the motor vehicle lock 3 is controlled by means of the control arrangement 4 in a relatch routine in such a way that a renewed latch state—relatch state—is basically avoided or cancelled within a predetermined relatch time interval R after the releasing process.

According to the proposal, in a relatch monitoring process the control arrangement 4 monitors whether a relatch indication, in particular a relatch state, occurs within the predetermined relatch time interval R after the releasing process, and only then is the relatch routine triggered. In this context, the relatch routine is preferably not triggered if a relatch indication, in particular a relatch state, is not detected during the monitoring.

In the solution according to the proposal the fact that a relatch state does not have to be completely implemented to trigger the relatch routine is also interesting. It is conceivable, as indicated above, that the relatch routine is already started when the monitoring only results in a relatch indication. The relatch indication may be, for example, a restoring movement of the hatch door 2 after the releasing process. Such a restoring movement is, of course, always associated with a certain relatch risk.

However, it is also conceivable that a relatch routine is started by means of the control arrangement 4 at or after each releasing process without it mattering whether a relatch indication or a relatch state is present. This is particularly interesting if there is the option of the control arrangement adjusting the motor vehicle lock into the released state for a predetermined time, as will be explained below.

The method according to the proposal in hatch arrangements 1 which are equipped with a hatch drive 8 which is assigned to the hatch door 2 is of particular significance. In this context, a motor-powered opening process can be triggered in the opening direction and/or a motor-powered closing process can be triggered in the closing direction by the control arrangement 4, in particular by means of predetermined user actions. Such a hatch drive 8 is illustrated entirely schematically in FIG. 1.

In order to avoid the opening force of the hatch drive 8 operating counter to the securing force of the motor vehicle lock 3, the hatch drive 8 and the opening drive 6 of the motor vehicle lock 3 are to be synchronized with one another. In particular it is proposed that a motor-powered releasing process always precedes a motor-powered opening process and that the relatch routine is configured such that when a relatch state is detected securing engagement of the motor vehicle lock 3 with the locking wedge 5 is avoided or released during the opening process.

Depending on the structural peripheral conditions, various variants may be advantageous for implementing the relatch routine.

A particularly preferred variant, which has already been referred to above, for implementing the relatch routine provides that in the relatch routine a further motor-powered releasing process is triggered. As a result, the above synchronization between the hatch drive 8 and the opening drive 6 of the motor vehicle lock 3 can be readily implemented.

Further, it is also conceivable that in the relatch routine the motor vehicle lock 3 is, as indicated above, adjusted into the released state by means of the control arrangement 4 for a predetermined release time interval. In one variant, in the relatch routine the motor vehicle lock is secured in the released state by means of the opening drive 6 for the release time interval and subsequently drops into an initial state, of whatever type, which is shown, for example, in FIG. 1*b*.

However, it is also possible that the motor vehicle lock 3 automatically maintains the released state, that is to say when the opening drive is non-energized, and that said motor vehicle lock 3 is adjusted to the initial state by means of the opening drive 6 or the like after the expiry of the release time interval. The width of the release time interval is between approximately 2 s and approximately 5 s, and is preferably however approximately 3 s, depending on the structural peripheral conditions.

As an alternative to implementing a release time interval, it is possible to provide that in the relatch routine the motor vehicle lock 3 is adjusted to the released state by means of the control arrangement 4 until a predetermined hatch deflection is achieved and a relatch process is largely ruled out.

Figure 2:
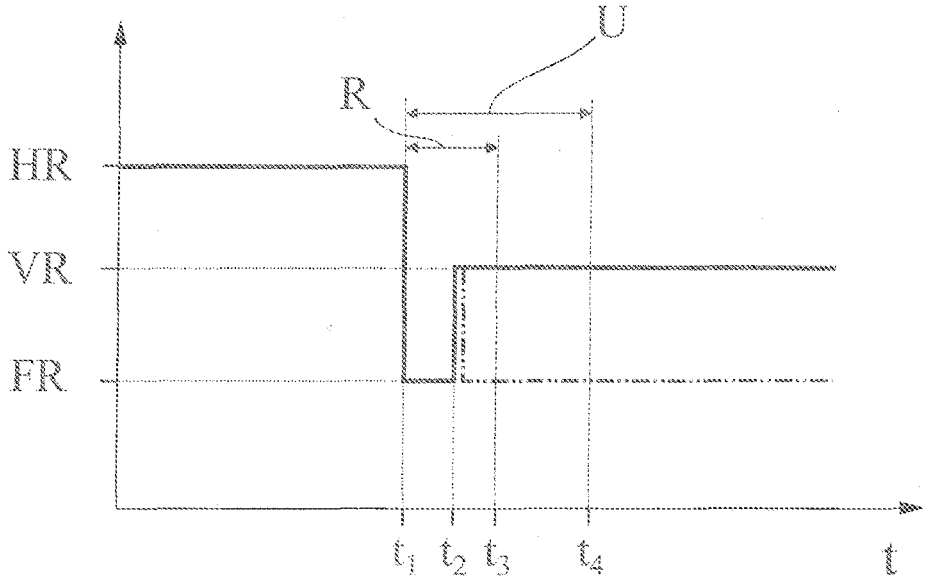
FIG. 2 shows the time profile of the state of the motor vehicle lock according to FIG. 1 during a relatch process.

FIG. 2 shows the time profile of a relatch process in an entirely schematic illustration. At the time $t_1$ the releasing process is started, with the result that the motor vehicle lock drops from a main latched state HR into a released state FR O. The hatch door 2 jumps up in the way described above (FIG. 1*b*) and subsequently drops into the position illustrated in FIG. 1*c*. In the process the motor vehicle lock reaches the prelatched state VR at the time $t_2$, here the relatch state which, with respect to the hatch deflection, lies between the released state FR and the main latched state. In this respect, the hatch door 2 can initially not actually be adjusted further in the opening direction.

In the preferred variant referred to above with relatch monitoring, the control arrangement 4 then checks whether the motor vehicle lock 3 drops back into a latched state within the relatch time interval R, which lies here between the times $t_1$ and $t_3$. Owing to the positive test result in FIG. 2, the control arrangement 4 triggers a relatch routine directly after the detection of the relatch state, that is to say directly after the time $t_2$. The relatch routine comprises a further motor-powered releasing process, with the result that the motor vehicle lock 3 once again reaches the released state FR, and the hatch door 2 jumps in the opening direction. This is illustrated by the dot-dash line in FIG. 2. The sealing counter pressure when the motor vehicle lock 3 is in the prelatched state is now reduced by the already slightly pivoted-out hatch door 2 in such a way that possible subsequent pivoting back of the hatch door 2 can no longer trigger a latched state.

Without the measure according to the proposal, the state of the lock would run further according to the unbroken line, with the result that it would not be possible to adjust the hatch door in the opening direction.

What is significant for the solution according to the proposal is the configuration of the relatch time interval R. Depending on the configuration of the hatch arrangement 1, time intervals of less than 5 seconds, in particular of less than 3 seconds, have proven appropriate here.

It is also of particular significance that the relatch monitoring for detecting a relatch process extends from a releasing process, over a sufficient time interval which is referred to below as "monitoring time interval U". This monitoring time interval U runs in the illustration according to FIG. 2 from the time $t_1$ up to the time $t_4$. The width of the monitoring time interval U is preferably less than three times, preferably less than twice, the width of the relatch time interval R.

In order to be able to detect the change in the state of the lock within the relatch time interval R, a corresponding sampling rate is to be set in the control arrangement 4 for the detection of the state of the lock during the relatch monitoring. The sampling rate of the control arrangement 4 is preferably at least 10 Hz, preferably at least 100 Hz, more preferably at least 200 Hz, during the detection of the state of the lock. The sampling rate of the control arrangement 4 can be reduced further outside the relatch monitoring in order to save computing power within the control arrangement 4.

FIG. 1 shows that the motor vehicle lock 3 has the customary locking elements 3*a*, specifically a lock latch 9 and a detent pawl 10 assigned to the lock latch 9, wherein in the released state the lock latch 9 is in an open position (FIG. 1*b*) and in the latched state it is in a prelatching position (FIG. 1*c*) or in a main latching position (FIG. 1*a*). The detent pawl 10 can be moved into a dropped-in position (FIGS. 1*a, c*) in which it holds the lock latch 9 in the prelatching position or in the main latching position. The detent pawl 10 can also be moved into a lifted-out position (FIG. 1*b*) in which it releases the lock latch 9. The lifting out of the detent pawl 10 occurs here and preferably by means of the opening drive 10 which, in the illustrated exemplary embodiment, is configured entirely schematically as a cable drive with a drive cable 11. An releasing process is based here on actuation of the opening drive 6 by means of the control arrangement 4 in such a way that the detent pawl 10 is lifted out in a motor-powered fashion.

A sensor arrangement 12 for detecting the state of the motor vehicle lock 3 is also illustrated entirely schematically in FIG. 1. The sensor arrangement 12 serves, depending on the configuration of the motor vehicle lock 3, to detect the position of the lock latch 9 and/or of the detent pawl 10. Numerous variants for the structural configuration of the sensor arrangement 12 are known from the prior art.

The control arrangement 4 preferably monitors the position of the lock latch 9 and/or of the detent pawl 10 in the relatch monitoring. Adjustment of the lock latch 9 from the open position into the locked position is defined here as a relatch indication.

In particular, the relatch routine is therefore started even if the motor vehicle lock 3 has only dropped partially again into a latched state within the relatch time interval R after the releasing process, which is detected as a relatch indication. In the illustrated exemplary embodiment, which is in this respect preferred, this could mean that the lock latch 9 has been adjusted in the direction of its locked position just to such an extent that the detent pawl 10 has not yet dropped in. It would be conceivable here, for example, that in the relatch routine the motor vehicle lock 3 is adjusted into the released state for a predetermined release time interval, as explained above. This would ensure that a complete latched state—relatch state—can certainly be prevented from occurring after this.

Owing to a further teaching, which is also accorded an independent significance, the control arrangement 4 explained above for a hatch arrangement 1 of a motor vehicle is claimed as such. Reference can therefore be made in this respect to the statements above.

What is claimed is:

1. A control arrangement for a hatch arrangement of a motor vehicle, the hatch arrangement including a hatch door, a motor vehicle lock and the control arrangement, and the motor vehicle lock having a latched state in which the motor vehicle lock is in securing engagement with a locking wedge and a released state in which the motor vehicle lock releases the locking wedge, wherein adjusting the hatch door in a closing direction moves the motor vehicle lock into engagement with the locking wedge and into the latched state, wherein an opening drive triggered by the control arrangement provides a motor powered releasing process in which the motor vehicle lock is moved from the latched state into a released state, and wherein the control arrangement controls the motor vehicle lock according to a relatch routine configured to avoid or cancel a relatch state within a predetermined relatch time interval after the releasing process, wherein the control arrangement provides a relatch monitoring process in which the control arrangement monitors whether a relatch indication occurs within the predetermined relatch time interval after the releasing process, and wherein the control arrangement triggers the relatch routine only after detecting a relatch indication within the predetermined relatch time interval after the releasing process.

2. The control arrangement according to claim 1, wherein the relatch indication comprises a relatch state.

3. The control arrangement according to claim 1, wherein the control arrangement triggers at least one of a motor-powered opening process in the opening direction and a motor-powered closing process in the closing direction, wherein the motor-powered releasing process always precedes the motor-powered opening process, and wherein the relatch routine is configured to, when the relatch state is detected, avoid or release a securing engagement of the motor vehicle lock with the lock wedge during the opening process.

4. The control arrangement according to claim 3, wherein the control arrangement triggers the motor-powered opening process in the opening direction, the motor-powered closing process in the closing direction, or both the motor-powered opening process and the motor-powered closing process, by means of predetermined user actions.

5. The control arrangement according to claim 1, wherein a further motor-powered releasing process is triggered in the relatch routine.

6. The control arrangement according to claim 1, wherein the relatch routine comprises the control arrangement placing the motor vehicle lock in the released state for a predetermined release time interval or until a predetermined hatch deflection is reached.

7. The control arrangement according to claim 6, wherein the release time interval is at least 2 seconds.

8. The control arrangement according to claim 6, wherein the release time interval is at least 3 seconds.

9. The control arrangement according to claim 1, wherein the relatch time interval is less than 5 seconds, the relatch monitoring for detecting a relatch state extends from a releasing process through a monitoring time interval that is less than three times the relatch time interval, or the relatch monitoring for detecting a relatch state extends from a releasing process through a monitoring time interval that is less than three times the relatch time interval and the relatch time interval is less than 5 seconds.

10. The control arrangement according to claim 9, wherein the relatch time interval is less than 3 seconds.

11. The control arrangement according to claim 9, wherein monitoring time interval is less than twice the relatch time interval.

12. The control arrangement according to claim 1, wherein during the relatch monitoring a sampling rate of the control arrangement is at least 10 Hz for the detection of the state of the lock.

13. The control arrangement according to claim 1, wherein the sampling rate of the control arrangement is at least 100 Hz.

14. The control arrangement according to claim 1, wherein the sampling rate of the control arrangement is at least 200 Hz.

15. The control arrangement according to claim 1, wherein the motor vehicle lock has a lock latch and a detent pawl assigned to the lock latch, and wherein the released state comprises the lock latch in an open position and the latched state comprises the lock latch in a prelatching position or in a main latching position, wherein the prelatching position and the main latching position comprise the detent pawl in a dropped-in position in which the detent pawl holds the lock latch and wherein the opening drive is configured to move the detent pawl into a lifted-out position to release the lock latch.

16. The control arrangement according to claim 15, wherein a sensor arrangement is provided for sensing the state of the lock.

17. The control arrangement according to claim 16, wherein the sensor arrangement is configured to sense the position of the lock latch, the detent pawl, or both the lock latch and the detent pawl.

18. The control arrangement according to claim 17, wherein in the relatch monitoring process the control arrangement monitors the position of the lock latch, the detent pawl, or both the lock latch and the detent pawl.

19. The control arrangement of claim 18, wherein movement of the lock latch from the open position in the closing direction is defined as a relatch indication.

* * * * *

UNITED STATES PATENT AND TRADEMARK OFFICE

CERTIFICATE OF CORRECTION

PATENT NO. : 9,045,921 B2
APPLICATION NO. : 13/468700
DATED : June 2, 2015
INVENTOR(S) : Eggeling et al.

It is certified that error appears in the above-identified patent and that said Letters Patent is hereby corrected as shown below:

On the title page

Item (75) "Muelheim an de Ruhr" should read --Muelheim an der Ruhr--.

In the claims

Claim 13, Column 9, Line 13, "claim 1" should read --claim 12--.

Signed and Sealed this
Ninth Day of February, 2016

Michelle K. Lee

Michelle K. Lee
*Director of the United States Patent and Trademark Office*